US011253901B2

(12) United States Patent
Avrillaud et al.

(10) Patent No.: US 11,253,901 B2
(45) Date of Patent: Feb. 22, 2022

(54) INDIRECT ELECTROHYDRAULIC PRESS FORMING TOOL, DEVICE AND METHOD

(71) Applicant: ADM28 S.ÀR.L, Luxembourg (LU)

(72) Inventors: Gilles Avrillaud, Pinsaguel (FR); Eric Mandel, St Quentin (FR)

(73) Assignee: ADM28 S.ÀR.L, Luxembourg (LU)

( * ) Notice: Subject to any disclaimer, the term of this patent is extended or adjusted under 35 U.S.C. 154(b) by 386 days.

(21) Appl. No.: 16/324,100

(22) PCT Filed: Jul. 25, 2017

(86) PCT No.: PCT/EP2017/068757
§ 371 (c)(1),
(2) Date: Feb. 7, 2019

(87) PCT Pub. No.: WO2018/028979
PCT Pub. Date: Feb. 15, 2018

(65) Prior Publication Data

US 2019/0168280 A1 Jun. 6, 2019

(30) Foreign Application Priority Data

Aug. 9, 2016 (FR) ..... 1657662

(51) Int. Cl.
*B21D 26/12* (2006.01)
*B21D 22/02* (2006.01)
(Continued)

(52) U.S. Cl.
CPC ..... *B21D 26/12* (2013.01); *B21D 22/02* (2013.01); *B30B 1/001* (2013.01); *B21D 28/007* (2013.01)

(58) Field of Classification Search
CPC ..... B21D 26/06; B21D 26/08; B21D 26/12; B21D 28/007; B30B 1/001; B30B 1/002; B30B 1/005; B30B 1/007
See application file for complete search history.

(56) References Cited

U.S. PATENT DOCUMENTS 3,267,780 A * 8/1966 Roth ..... B21D 26/12 83/880
3,377,902 A 4/1968 Bodenseher
(Continued)

FOREIGN PATENT DOCUMENTS

DE 1919095 A1 * 11/1970 ..... B30B 1/007
JP 2001-526962 A 12/2001
(Continued)

OTHER PUBLICATIONS

Machine Translation of DE 1919095, Retrieved from Espacenet Apr. 16, 2021, 3 Pages. (Year: 1970).*
(Continued)

*Primary Examiner* — Gregory D Swiatocha
(74) *Attorney, Agent, or Firm* — Seed Intellectual Property Law Group LLP

(57) ABSTRACT

An indirect electrohydraulic draw-forming tool includes a body having a tubular cylindrical area, a chamber intended to be filled with a liquid, two electrodes, each of the electrodes having a portion arranged in the chamber, a punch. The tool also includes a piston mounted so as to slide in a sealed manner within the cylindrical area and sealingly defining the chamber. Moreover, the punch is carried by the piston on a face thereof that is opposite to the chamber.

8 Claims, 2 Drawing Sheets

(51) Int. Cl.
*B30B 1/00* (2006.01)
*B21D 28/00* (2006.01)

(56) References Cited

U.S. PATENT DOCUMENTS

| | | | | | |
|---|---|---|---|---|---|
| 3,548,630 | A * | 12/1970 | Chelminski | B21D 22/12 | 72/430 |
| 3,673,833 | A * | 7/1972 | Cadwell | B21J 15/20 | 72/56 |
| 4,068,514 | A * | 1/1978 | Chachin | B21D 26/12 | 72/454 |
| 4,909,061 | A * | 3/1990 | Reitter | B21D 24/14 | 72/334 |
| 10,201,843 | B2 * | 2/2019 | Avrillaud | B21D 26/12 | |
| 2009/0272167 | A1 | 11/2009 | Golovashchenko | | |
| 2015/0343512 | A1 | 12/2015 | Plau | | |
| 2015/0360275 | A1 | 12/2015 | Avrillaud | | |
| 2017/0355007 | A1 * | 12/2017 | Plaut | B21D 26/12 | |

FOREIGN PATENT DOCUMENTS

| | | | |
|---|---|---|---|
| SU | 1750847 | A1 * | 7/1992 |
| WO | 99/33590 | A2 | 7/1999 |

OTHER PUBLICATIONS

Machine Translation of SU 1750847, Retrieved from Google Apr. 9, 2021, 7 Pages. (Year: 1992).*

* cited by examiner

INDIRECT ELECTROHYDRAULIC PRESS FORMING TOOL, DEVICE AND METHOD

BACKGROUND

Technical Field

The invention relates to a tool, a device, and a method for indirect electrohydraulic draw-forming of materials.

Description of the Related Art

Drawing is one of the most commonly used methods for forming materials, in particular sheet metal workpieces such as automotive body parts. It consists of retaining a blank of material by its edges with a blank holder and deforming the free portion of the blank of material by applying a punch—called a forming tool—in a die, the punch and die each having an external shape that is substantially identical, aside from accommodating the thickness of the sheet, to the desired shape of the workpiece to be obtained. To do this, the punch is applied with a predetermined force against the blank of material to be deformed. The blank of material undergoes permanent plastic deformation when the applied stress exceeds the yield strength of the material to be deformed. However, when the applied stress is released, the portion of the stress absorbed by elastic deformation induces a springback substantially altering the dimensional characteristics of the workpiece. To take into account the springback of the workpiece, punch and die geometries are used that compensate for the springback of the workpiece. However, a sometimes long phase of tool development is often still required in order to obtain a workpiece with the desired geometry. Another difficulty encountered with drawing methods is obtaining details such as embossing or sharp lines on the workpieces to be formed. This difficulty is often encountered due to a lack of locally available pressure or due to reaching the forming limits of the material.

Document FR3000909 presents a draw-forming method comprising a conventional drawing step and an electrohydraulic forming step. For this purpose, the punch is formed by the lower surface of a chamber comprising a liquid and electrodes. During the conventional drawing step, a quasi-static force is applied to the punch in order to plastically deform the workpiece. This force is maintained when an electric discharge is generated between the two electrodes in order to produce a shock wave that elastically deforms the wall of the punch against the workpiece and transmits a portion of the shock wave to the workpiece. This step aims to reduce the springback of the workpiece when the punch is no longer exerting pressure on the workpiece. However, this solution does not allow moving the punch assembly at high speed over the workpiece, which does not permit actual shaping of the workpiece and limits its application to the reduction of springback.

BRIEF SUMMARY

The present invention aims to overcome the above disadvantages of the prior art.

To this end, a first aspect of the invention provides a tool for indirect electrohydraulic draw-forming, comprising:

a body having a tubular cylindrical area, a chamber (115; 215) intended to be filled with a liquid, two electrodes (116*a*, 116*b*; 216*a*, 216*b*), each of the electrodes having a portion arranged in the chamber (115; 215), a punch (111; 211).

The tool also comprises a piston mounted so as to slide in a sealed manner within the cylindrical area and sealingly defining the chamber. The punch is carried by the piston on a face thereof that is opposite to the chamber.

According to the invention, when an electric discharge is generated in the chamber filled with liquid, a shock wave propagates in the chamber and causes high-speed movement of the piston. The punch carried by the piston then strikes the blank of material to be deformed at high speed. Compared with a conventional electrohydraulic forming process, the workpiece is not in contact with water, which tends to increase production rates and avoid contact of the workpiece with water which can cause corrosion issues and/or the potential need for drying.

"Indirect electrohydraulic forming" is understood to mean the forming of a blank of material by applying an electrohydraulic discharge wherein the blank of material is not directly in contact with the liquid in the chamber in which the electrodes are located. In the rest of this patent application, it is assumed that an electrohydraulic discharge has occurred when an electric discharge generated in the liquid in the chamber has resulted in a shock wave.

The tool according to the invention allows quickly and easily forming workpieces providing improvements over those formed by conventional drawing methods, particularly a reduced springback and/or fine details such as embossing, and/or reduced form radii, and/or improved local elongation before rupture. In addition, the use of such a tool makes it possible to produce workpieces having the advantages of workpieces formed by electrohydraulic forming without presenting the disadvantages, namely the existence of a direct contact between the liquid of the chamber and the blank of material to be deformed. Note also that the lower surface of the punch may be flat or relief, depending on the geometry of the workpiece to be formed, the same being true for the die.

In an alternative embodiment, one of the electrodes comprises an end immersed in the chamber and the other electrode comprises an inner surface of the body present in the chamber.

This configuration allows using the inner surface of the chamber as an electrode. Compared to a configuration where two electrodes each have one end in the chamber, it eliminates the risk of "undesirable" electrical breakdown on the wall of the chamber. However, this configuration is only suitable for chambers of small diameter, where the chamber-electrode distance allows obtaining sufficient output.

In another alternative embodiment, the two electrodes each have one end in the chamber.

The use of two electrodes which each have one end in the chamber allows adapting to different types of chambers by optimizing the arrangement of the electrodes and their spacing. In addition, electrode maintenance is facilitated since they can both easily be replaced when eroded, while in the previous configuration it would also be necessary to change the chamber. Note that to avoid "undesirable" breakdown, the two electrodes must be insulated from the chamber. This configuration is particularly suitable for large chambers.

In one embodiment, the body has an opening through which the protruding punch can exit the body.

In one embodiment, the opening is created in a transverse wall and at least biasing means are arranged between said transverse wall and the piston face bearing the punch.

The return means enable the piston to return to its original position when the tool is placed above the blank of material to be deformed. In contrast, when the tool is placed below the blank of material, the piston can be returned to its original position by simple gravity. The return means may be springs, Belleville washers, or elastomers having sufficient elasticity, for example.

In one embodiment, the tool comprises a pump for placing the liquid in the chamber under pressure.

The pump makes it possible to place the liquid in the chamber under quasi-static pressure and to initiate movement of the piston before the electrohydraulic discharge. Moreover, if the quasi-static pressure is sufficient, the punch can press against the blank of material with sufficient quasi-static force to stamp the blank of material. The electrohydraulic discharge makes it possible to exert dynamic pressure in order to accelerate the punch and obtain the benefits related to indirect electrohydraulic forming.

A second aspect of the invention provides a device for indirect electrohydraulic draw-forming, comprising a die and a tool having a body and a punch. The die and the punch are of generally complementary shape. The device is adapted to hold the tool and the die such that the punch and the die are opposite one another and at a predetermined distance from a blank of material to be deformed, the blank of material being in contact with the die and being held against the die with a predetermined force. The punch is carried by a piston mounted so as to slide in a sealed manner within the tubular cylindrical area of the body while defining a sealed chamber intended to be filled with a liquid. The punch is arranged on a face of the piston opposite to the chamber. The tool further comprises two electrodes, each electrode having a portion arranged in the chamber.

In the majority of drawing devices, a blank holder is used at the edge of the blank to control the drawing of the blank during action of the punch. In some cases, especially when deep drawing a large workpiece, the force of the blank holder is controlled to avoid wrinkles on the workpiece while allowing the material to be drawn into the die and thereby limiting the elongation of the material, which could lead to ruptures. In other cases, particularly when shallow drawing a small workpiece, the blank holder can be used to lock the blank in place and avoid any drawing. A blank holder may also be used in the device according to the invention, to ensure these functions.

In one embodiment, one of the electrodes comprises an end immersed in the chamber and the other electrode comprises an inner surface of the body present in the chamber.

This configuration allows using the inner surface of the chamber as an electrode. Compared to a configuration where two electrodes each have one end in the chamber, it eliminates the risk of "undesirable" electrical breakdown on the wall of the chamber. However, this configuration is only suitable for chambers of small diameter, where the chamber-electrode distance allows obtaining sufficient output.

In one embodiment, the two electrodes each have one end in the chamber.

The use of two electrodes which each have one end in the chamber allows adapting to different types of chambers by optimizing the arrangement of the electrodes and their spacing. In addition, electrode maintenance is facilitated since they can both easily be replaced when eroded, while in the previous configuration it would also be necessary to change the chamber. Note that to avoid "undesirable" breakdown, the two electrodes must be insulated from the chamber. This configuration is particularly suitable for large chambers.

In one embodiment, the body of the tool includes a transverse wall having an opening through which the punch can exit.

This transverse wall may be used to serve as a blank holder and to control the drawing of the blank during shaping.

In one embodiment, the tool comprises return means arranged between the transverse wall of the body and the piston face bearing the punch.

The return means enable the piston to return to its original position when the tool is placed above the blank of material to be deformed. In contrast, when the tool is placed below the blank of material, the piston can be returned to its original position by simple gravity.

In one embodiment, the device for indirect electrohydraulic draw-forming comprises a pump for pressurizing the liquid in the chamber.

The pump makes it possible to place in the liquid in the chamber under quasi-static pressure and to initiate movement of the piston before the electrohydraulic discharge. Moreover, if the quasi-static pressure is sufficient, the punch can press against the blank of material with sufficient quasi-static force to stamp the blank of material. The electrohydraulic discharge makes it possible to exert dynamic pressure in order to accelerate the punch and obtain the benefits related to indirect electrohydraulic forming.

A third aspect of the invention provides a method for indirect electrohydraulic draw-forming, comprising the following steps:

- placing a tool for indirect electrohydraulic draw-forming such as the one described above and having a punch, at a predetermined distance from the blank of material to be deformed, and
- causing the piston bearing the punch to move by means of an electric discharge generated between the at least two electrodes.

The method according to the invention allows obtaining workpieces having a reduced springback and/or finer details such as embossing, and/or reduced form radii, and/or improved local elongation before rupture.

In one embodiment, the tool is placed in contact with the blank of material to be deformed with a predetermined force.

The tool placed in contact with the blank of material acts as a blank holder. This makes the assembly more compact and reduces the size of the blank of material to be formed and thus reduces costs.

In one embodiment, the liquid of the chamber is placed under quasi-static pressure before the electric discharge.

Placing the liquid present in the chamber under quasi-static pressure makes it possible to initiate movement of the piston before the electrohydraulic discharge. Moreover, if the quasi-static pressure is sufficient, the punch can press against the blank of material with sufficient quasi-static force to stamp the blank of material.

Advantageously, the placing under quasi-static pressure is achieved by a pump.

In one embodiment, the punch is applied against the blank of material to be deformed with a predetermined quasi-static force.

The predetermined quasi-static force may be exerted directly on the tool or after placing the liquid in the chamber under quasi-static pressure.

A blank of material can therefore be formed by combining a conventional drawing step then a step of indirect electrohydraulic draw-forming by the application of an electrohydraulic discharge.

BRIEF DESCRIPTION OF DRAWINGS

Details and advantages of the invention will become more apparent from the following description, made with reference to the accompanying drawings in which.

DETAILED DESCRIPTION

Figure 1A:
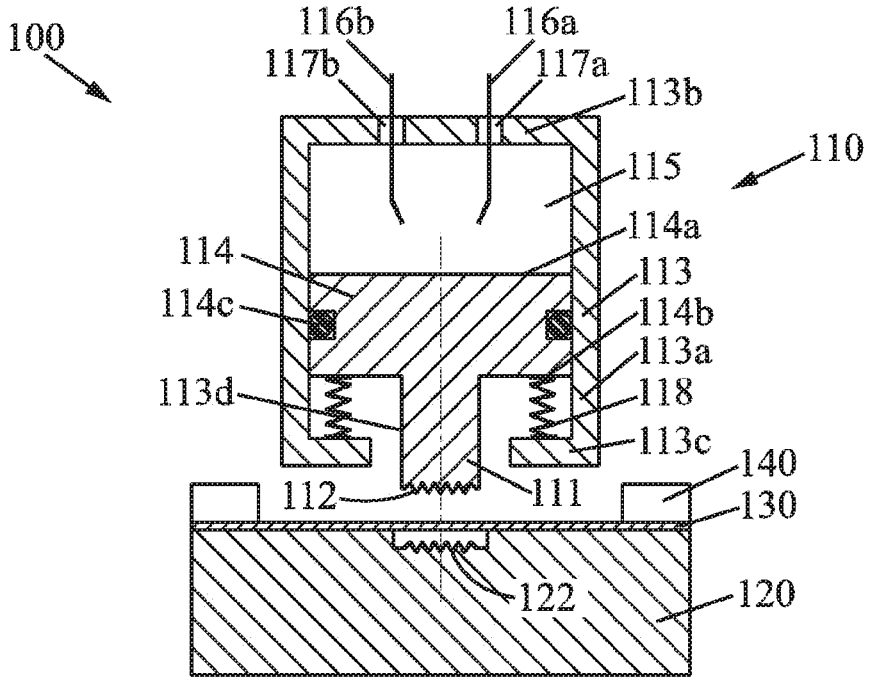
FIGS. 1A and 1B show a first embodiment, FIG. 1A showing the forming device prior to electrohydraulic discharge and FIG. 1B showing the device shortly after electrohydraulic discharge.
Figure 1B:
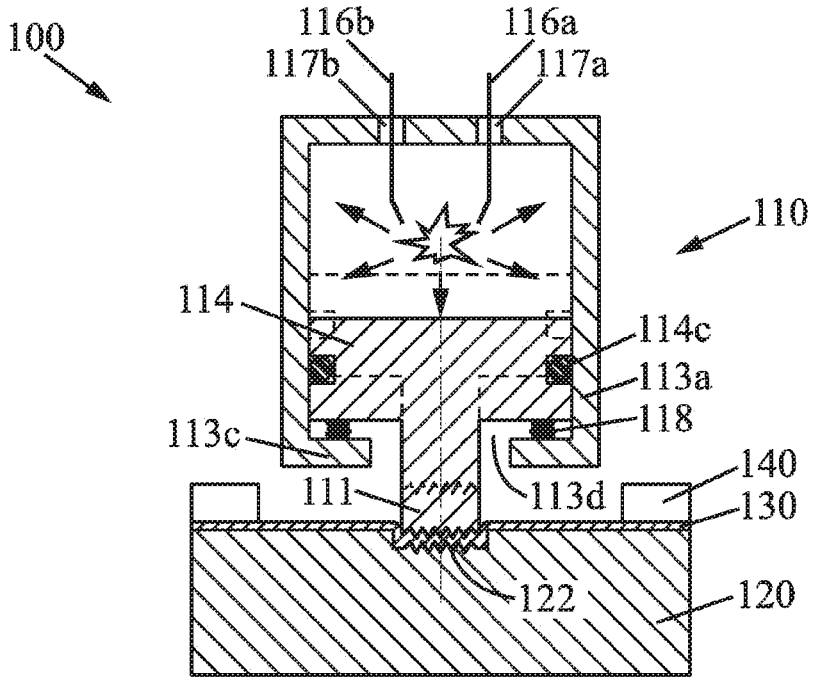

FIGS. 1A and 1B show a device for indirect electrohydraulic draw-forming according to a first embodiment. The device for indirect electrohydraulic draw-forming 100 comprises a tool 110, a die 120, and a blank holder 140. A blank of material to be formed 130, here a metal sheet, is held between the blank holder 140 and the die 120. The blank holder is used to control the drawing of the blank during the indirect electrohydraulic forming. The force of the blank holder is controlled in order to avoid wrinkles on the workpiece while permitting the material to be drawn into the die, thereby limiting the elongation of the material which could lead to ruptures. In this embodiment, the tool 110 is above the die 120 and the blank of material to be formed 130. The tool 110 includes a punch 111 of a general shape complementary to that of the die 120 in order to allow insertion of the punch 111 into the die 120 while accommodating the thickness of the sheet. The punch 111 is positioned opposite a cavity 122 of the die 120. In the embodiment illustrated with reference to FIGS. 1A and 1B, the surface 112 of the punch 111 comprises reliefs substantially identical to those present on the cavity 122 of the die 120.

The tool 110 includes a body 113 and a piston 114 bearing the punch 111. The body 113 includes a tubular cylindrical area 113*a* closed off by an upper transverse wall 113*b* and a lower transverse wall 113*c*. The lower transverse wall 113*c* has an opening 113*d* through which the punch 111 can exit the body 113. The piston 114 is mounted so as to slide in a sealed manner within the tubular cylindrical area 113*a*. It has a top face 114*a*, a bottom face 114*b*, and sealing means 114*c*, here an O-ring. The piston 114, and more particularly its bottom face 114*b*, rests on biasing means, here a coil spring 118 pressing against the lower transverse wall 113*c*. Other biasing means may be used, such as Belleville washers or elastomers having sufficient elasticity to cause the piston to return to its initial position. The punch 111 is carried by the lower face 114*b* of the piston. A chamber 115 is formed in the tubular cylindrical area between the upper transverse wall 113*b* and the upper wall 114*a* of the piston 114. This chamber 115 is fluidtight due to the sealing means 114*c* and is completely filled with a liquid such as water.

The tool 110 also comprises two electrodes 116*a*, 116*b* entering the chamber 115 through sealed feed-throughs 117*a*, 117*b*. In this embodiment, the electrodes 116*a*, 116*b* are electrically insulated on their periphery. Only the ends facing each other are bare.

When both electrodes 116*a*, 116*b* are subjected to a large potential difference, an electric discharge occurs between the two electrodes as shown in FIG. 1B. This electric discharge causes a shock wave which propagates in the chamber 115 and exerts strong downward pressure on the piston 114. The punch 111 then strikes or rather presses the blank of material 130 against the cavity 122 of the die 120 at a high speed. During the drawing, the tool 110 and the die 120 are held relative to each other. The device 100 therefore comprises means for holding the tool and the die so that the punch and the die are opposite one another and at a predetermined distance from the blank of material. For this purpose, the tool 110 and the die 120 are mounted between the platens of a press or of a specific frame. To avoid tearing the sheet, a blank holder is used with a controlled force in order to lock the blank in place or control its drawing and avoid the formation of wrinkles.

Figure 2A:
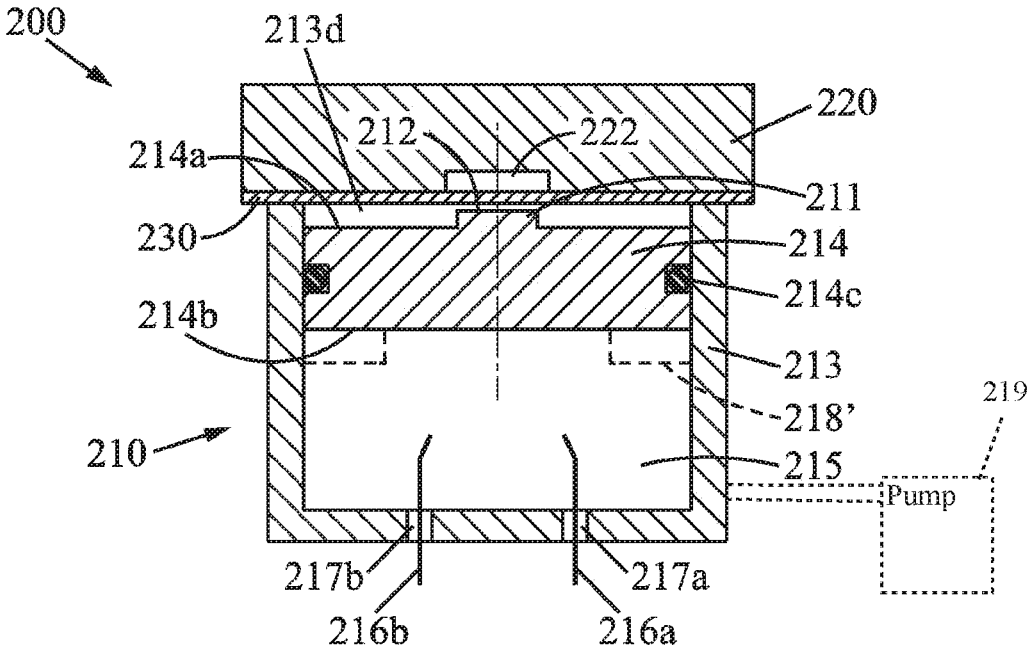
FIGS. 2A and 2B show a second embodiment, FIG. 2A showing the forming device prior to electrohydraulic discharge and FIG. 2B showing the device shortly after electrohydraulic discharge.
Figure 2B:
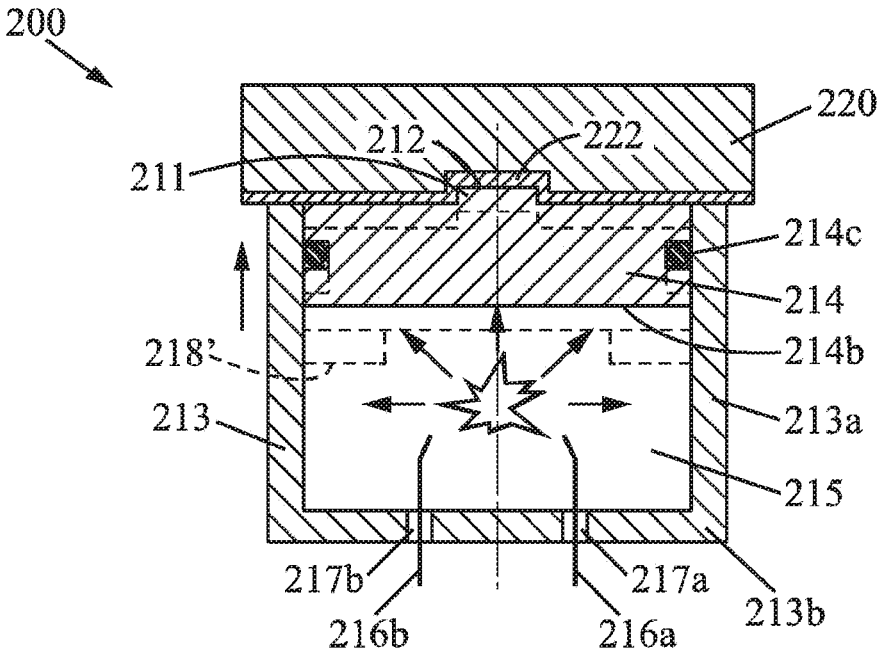

FIGS. 2A and 2B show a device for indirect electrohydraulic draw-forming according to a second embodiment. Some elements of this device are similar to those described with reference to FIGS. 1A and 1B. These elements will therefore be numbered in the same manner but will begin with 200 instead of 100.

The device for indirect electrohydraulic draw-forming 200 again comprises a tool 210 and a die 220. In this embodiment, the tool 210 is located below the die 220 and below the blank of material when the latter is held between the die 220 and the tool 210. The cavity 222 of the die is located on the lower face of the die, on the portion in contact with the blank of material 230 when the blank is held between the tool 210 and the die 220. The tool is arranged so that the punch is facing the cavity 222 of the die 220.

In this embodiment, the device 200 does not comprise a blank holder as such. The tool 210, being arranged against the blank of material to be deformed so as to exert a constant and predetermined force, acts as a blank holder. The device 200 for indirect electrohydraulic draw-forming therefore comprises means for holding the tool 210 at a predetermined distance from the blank of material to be deformed with a predetermined force. The tool 210 may be in contact with the blank to be formed or to a distance of less than 1 mm, preferably 0.1 mm. The device 200 also comprises means for holding the die 220 at a predetermined distance relative to the tool and to the blank of material to be deformed.

In the variant embodiment illustrated with reference to FIGS. 2A and 2B, the surface 212 of the punch 211 and the surface of the cavity 222 of the die 220 are planar. Any other shape of the surface of the cavity 222 of the die can be considered. The shape of the surface 112 of the punch may either remain flat or have a shape substantially similar to the cavity 222 of the die.

As in the first embodiment, the tool 210 comprises a body 213 and a piston 214 bearing the punch 211. In this second embodiment, the body 213 has a tubular cylindrical area 213 closed off by a lower transverse wall 213*b* and has no upper transversal wall. The upper portion of the body 210 is therefore not closed off. The tubular end portion of the body 210 is flat and is in direct contact with the blank of material to be deformed. The piston 214 is mounted so as to slide in a fluidtight manner within the tubular cylindrical area 213*a*. It has an upper face 214*a*, a lower face 214*b*, and sealing means 214*c*. The punch 214 is carried by the upper face 214*b* of the piston. The piston 214 is adapted to move longitudinally towards the blank of material. In this particular embodiment, the body 213 of the tool is in contact with the blank of material. However, in an alternative embodiment, the tool 210 could include a transverse wall having an opening to allow the punch to exit the body. As in the first embodiment, the piston 214 defines a sealed chamber 215 to be filled with a liquid and the tool 210 also comprises two electrodes 216*a*, 216*b* each having one end arranged in the chamber. In another embodiment, one of the electrodes

216*a*, 216*b* comprises an end immersed in the chamber 215 and the other electrode comprises a conductive inner surface of the body 113, 213 defining the chamber 115, 215.

When the two electrodes 216*a*, 216*b* are subjected to a large potential difference, an electric discharge occurs between the two electrodes as shown in FIG. 2B. This electric discharge causes a shock wave which propagates in the chamber 215 and exerts strong upward pressure on the piston 214. The punch 211 then exerts strong pressure on the blank of material 230 with high speed. In an alternative embodiment, the movement of the piston may be initiated or facilitated by placing the liquid of the chamber under quasi-static pressure, by means of a pump 219. The pump serves to inject pressurized liquid into the chamber until the desired pressure in the chamber is reached. Valves and pipes able to withstand the pressure of the liquid injected into the chamber may be used. The pressurization must be slow enough that the liquid pressure is uniform throughout the chamber, which is what is meant by placing the liquid "under quasi-static pressure".

If the quasi-static pressure is sufficient, the punch can press against the blank of material with sufficient quasi-static force to stamp the blank of material. The electrohydraulic discharge exerts dynamic pressure to accelerate the punch.

The piston 214 is then returned to its initial position, illustrated with reference to FIG. 2A, by simple gravity. The water present in the chamber 215 acts as a backstop device. In another variant, the body 213 includes a backstop device stop 218' illustrated with dotted lines in FIG. 2B. The tool shown in this second embodiment has the advantage of being lighter, since it does not include any biasing means.

The electrohydraulic discharge allows moving the punch at high speed, thereby generating strong pressure at the workpiece to be formed. The drawing thus obtained has reduced springback and/or finer embossing and/or reduced form radii, and/or improved local elongation before rupture, potentially with fewer passes in comparison to conventional drawing. Finer embossing can be obtained when the surface of the punch and/or die have reliefs.

The invention is not limited to the embodiments described above nor to the variants mentioned, but also relates to any embodiment in the reach of the skilled person within the scope of the following claims.

The invention claimed is:

1. A tool for indirect electrohydraulic draw-forming, the tool comprising:

a body having a tubular cylindrical area;

a chamber formed in the body and configured to be filled with a liquid;

two electrodes, each of the electrodes having a portion arranged in, or at least partially defining, the chamber;

a punch;

a piston mounted so as to slide in a sealed manner within the cylindrical area and sealingly define the chamber;

wherein the punch is carried by the piston on a face thereof that is opposite to the chamber; and a pump for placing the liquid of the chamber under pressure, wherein the pump is configured to place the liquid in the chamber under quasi-static pressure and to initiate movement of the piston so that the punch is able to press against a blank of material with sufficient quasi-static force to stamp the blank of material.

2. The tool according to claim 1, wherein one of the electrodes comprises an end immersed in the chamber and the other electrode comprises an inner surface of the body defining the chamber.

3. The tool according to claim 1, wherein the two electrodes each have one end in the chamber.

4. The tool according to claim 1, wherein the body has an opening through which the protruding punch can exit the body.

5. The tool according to claim 4, wherein the body includes a transverse wall through which the opening extends, the tool further comprising biasing means, arranged between said transverse wall and the piston face bearing the punch, for biasing the piston away from the transverse wall.

6. A device for indirect electrohydraulic draw-forming, comprising:

the tool for indirect electrohydraulic draw-forming of claim 1; and a die, the die and the punch being of generally complementary shape, said device being configured to hold the tool and the die such that the punch and the die are opposite one another and at a predetermined distance from each other to enable placement between the punch and die of a blank of material to be deformed, the blank of material being in contact with the die and being held against the die with a predetermined force.

7. A method for indirect electrohydraulic draw-forming, comprising:

placing the tool for indirect electrohydraulic draw-forming according to claim 1 such that the punch is at a predetermined distance from the blank of material to be deformed; and causing the piston bearing the punch to move by means of an electric discharge generated between the at least two electrodes, wherein the liquid of the chamber is placed under quasi-static pressure before the electric discharge, the placing under quasi-static pressure being achieved by a pump, the punch being applied against the blank of material to be deformed with a predetermined quasi-static force causing the punch to stamp the blank of material.

8. The method according to claim 7, wherein the tool is placed in contact with the blank of material to be deformed with a predetermined force.

* * * * *